United States Patent [19]

Horniak

[11] 4,272,001

[45] Jun. 9, 1981

[54] TICKET DISPENSER

[76] Inventor: Stephen Horniak, 424 Cedar Hill Rd., Ambler, Pa. 19002

[21] Appl. No.: 84,865

[22] Filed: Oct. 15, 1979

[51] Int. Cl.[3] ..... B65H 17/10

[52] U.S. Cl. ..... 226/187; 226/193; 225/12

[58] Field of Search ..... 242/55.2, 55; 226/134, 226/144, 145, 191, 193, 186, 187; 225/16, 23, 12, 14; 221/5, 71, 277

[56] References Cited

U.S. PATENT DOCUMENTS

| | | | |
|---|---|---|---|
| 2,487,061 | 11/1949 | Ptasnik | 225/23 X |
| 3,782,616 | 1/1974 | Surber, Jr. | 226/135 X |

*Primary Examiner*—Stanley H. Tollberg
*Attorney, Agent, or Firm*—Raymond Underwood

[57] ABSTRACT

A ticket dispenser includes a drive roller and an idler roller so that power rotation of the drive roller advances tickets between them; the drive roller is movable toward and away from the idler roller and is so disposed and supported that a manual pull on the tickets to withdraw them when the power is off will serve to bind the tickets firmly between the rollers and prevent them from being pulled out.

10 Claims, 6 Drawing Figures

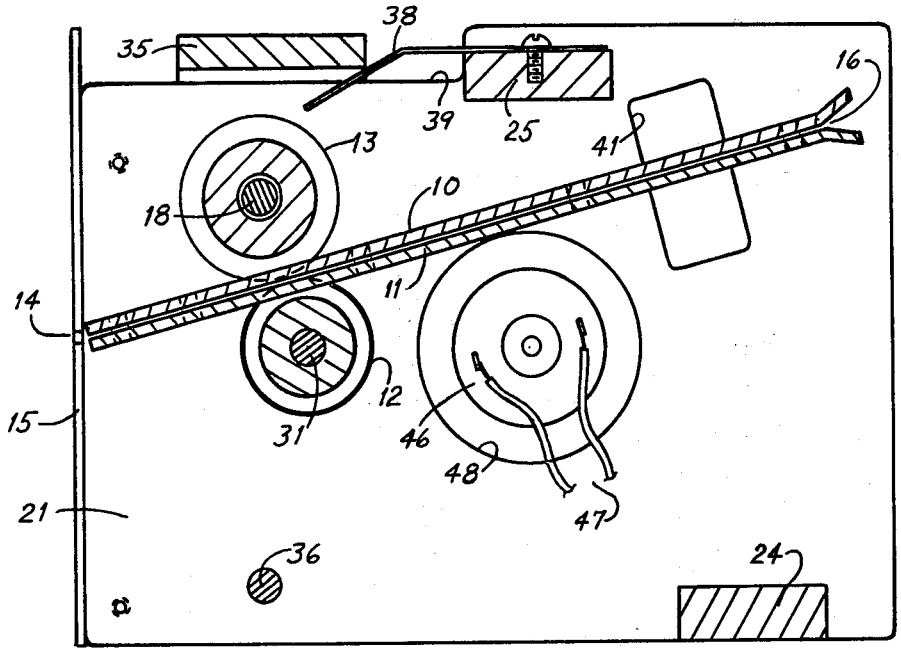
FIG. 3
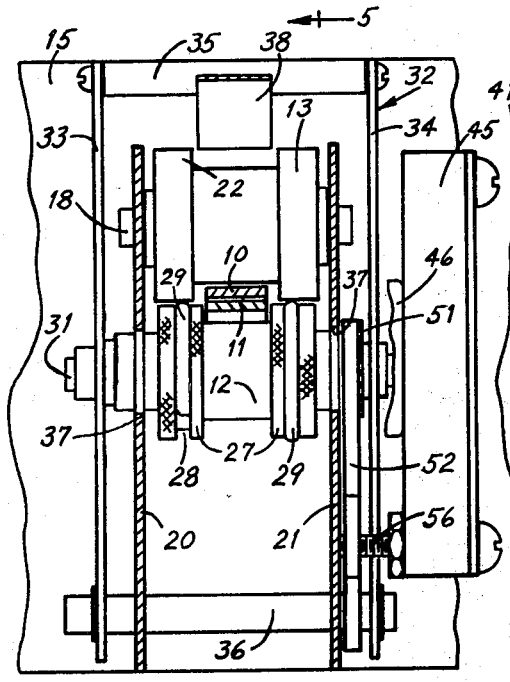
FIG. 4 ←5
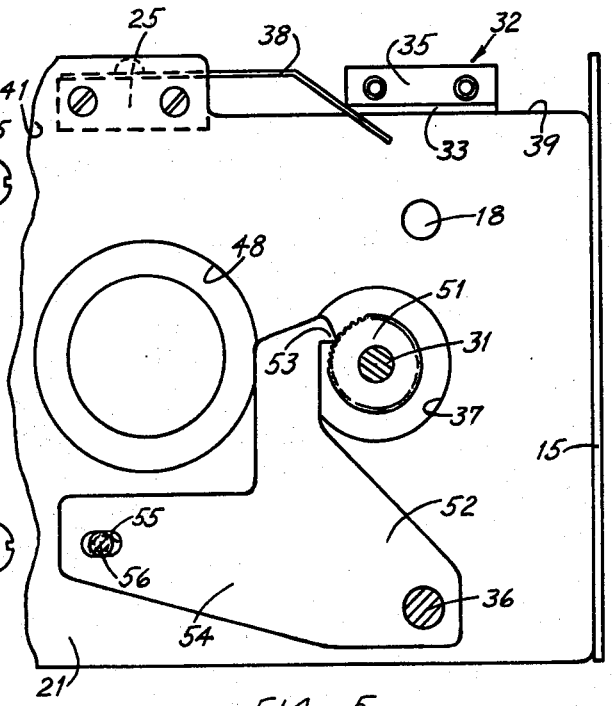
FIG. 5

TICKET DISPENSER

This invention relates to ticket dispensing machines and particularly to one which limits the withdrawal of tickets to only the one or ones which have been paid for or are otherwise released for delivery.

The invention will be described with special reference to machines for issuing conventional theater; game or sporting event tickets but the machine may as well be used to dispense stamps or other ticket-like units from a long strip or web. The tickets, stamps, etc., are supplied in the form of a large roll and upon command one or a designated number of them are advanced to the outside of the machine to be torn off.

One representative use of the machine of the invention is to associate it with a coin operated mechanism which will give the ticket dispensing machine a signal which will initiate its operation. Upon insertion of the proper coin, a power unit such as an electric motor will automatically be energized to thereby operate the machine to advance one or more tickets to the outside of the machine. Another application of the machine is to attach it to a game apparatus such as a skee-ball machine or a pin-ball machine so that when a predetermined score is reached the ticket dispenser will automatically deliver a pre-set number of tickets. These tickets can then be torn off and be used to play more games or to obtain a prize, for instance.

Ticket dispensing machines are well known in the art but they have had the defect of permitting the occasional manual withdrawal of an unearned ticket. Instead of tearing off the ticket which has been advanced out of the machine, persons will use it to pull on the strip still in the machine and thereby try to withdraw additional tickets from the machine. This surreptitious effort, when it succeeds, will be very costly to the owner of the machine.

The ticket dispensing machine of the present invention includes means for preventing such unauthorized withdrawal of tickets. These means function to grip the tickets still in the machine to prevent their advancing movement out of the machine. In fact, the pulling force exerted to withdraw the tickets from the machine is utilized to apply the pressure on the tickets which holds them against the pulling force. This machine assures its owner that only authorized tickets can be obtained from it.

Figure 1:
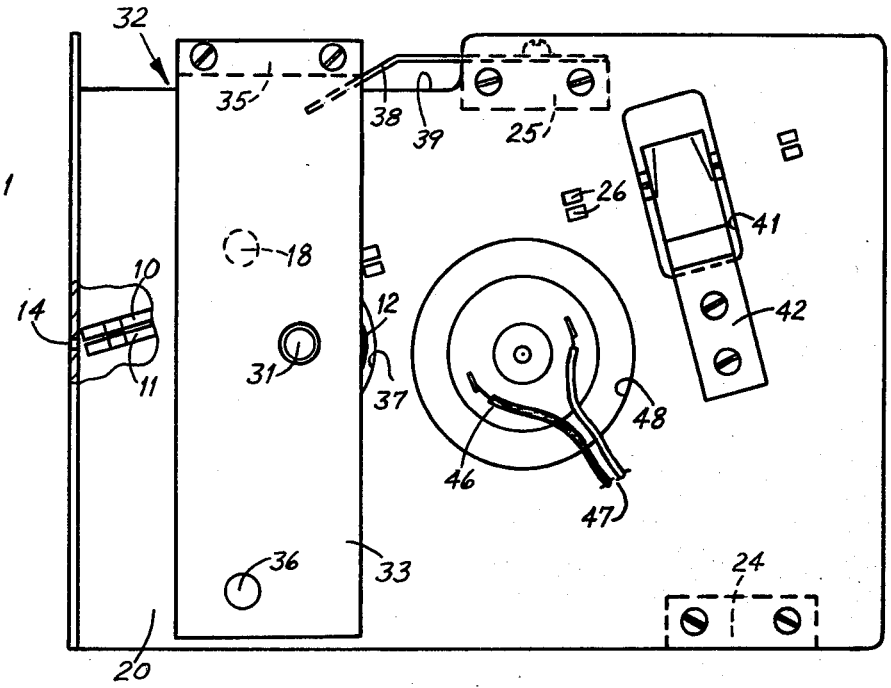
Figure 2:
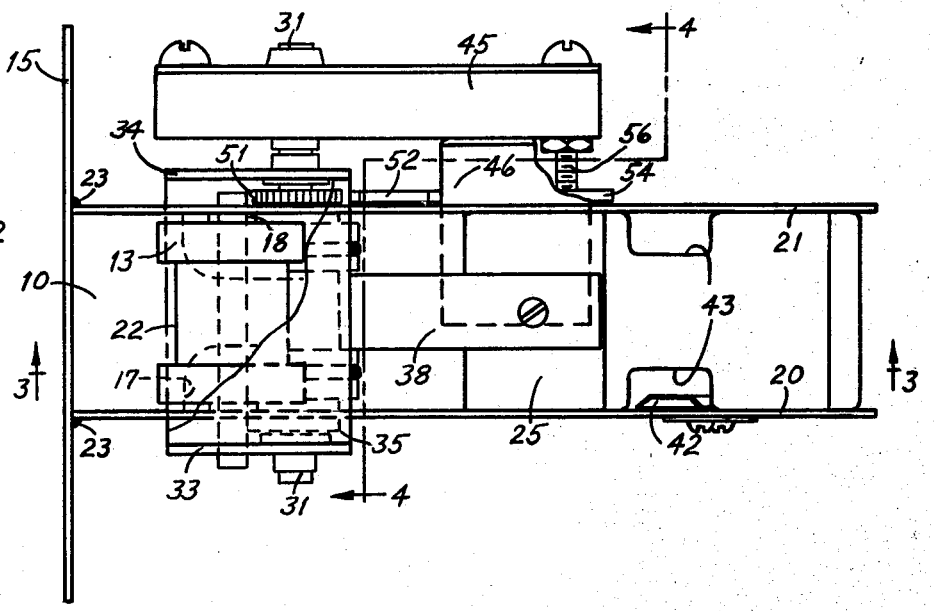
Figure 6:
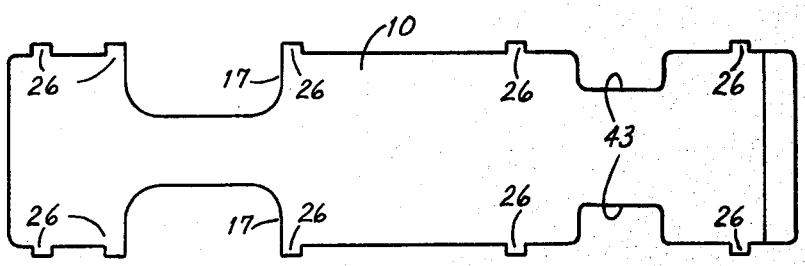

An embodiment of the invention is illustrated in the accompanying drawings in which:

FIG. 1 is a side elevational view, a part of the front side plate being broken away, FIG. 2 is a plan view, a portion of a top spacer plate and a portion of the motor being broken away to show underlieing structure, FIG. 3 is a section on the line 3—3 of FIG. 2, FIG. 4 is a section on the broken line 4—4 of FIG. 2, FIG. 5 is an elevational view on the line 5—5 of FIG. 4, showing the side opposite from that of FIG. 1, the left hand portion of the side plate being broken away, and FIG. 6 is a plan view of one of the guide plates which form the passageway for the strip of tickets.

Generally considered, as is shown in FIG. 3, the strip of tickets to be dispensed is fed through the passageway between 10, the top guide plate and the bottom guide plate 11. The ticket strip is advanced by the power roller 12 and the idler roller 13, and it is ejected through the slot 14 in the front framework plate 15. The strip of tickets (or like items) may be in the form of a roll or be layered back and forth on itself as is now practiced in this art. Its leading end is inserted between the flared entrance ends at 16 between the guide plates 10 and 11 and is advanced until the end reaches the front plate 15.

To facilitate the passage of the ticket strip between the rollers 12 and 13 when the machine is being initially loaded, they are slightly separated by hand pressure. Normally, the drive roller 12 is spring biased toward the idler roller 13, so that they frictionally press on the tickets. To permit this contact between the rollers, the guide plates 12 and 13 are formed at the edges with the cut-away notches 17 as is shown in FIG. 6.

The idler roller 13 is rotatably mounted on a shaft 18 the ends of which are bearinged in the two framework plates 20 and 21, which are spaced parallel to each other. The shaft 18 may be held against endwise displacement by conventional C-clips (not shown) or any other common means and this is true of the other shafts to be hereinafter mentioned. It does not matter whether the free rotation of the roller 13 is on the shaft 18 or this is due to rotation of the shaft in its bearings in the framework side plates 20 and 21. Washers (not shown) may be located between the roller 13 and the side plates to serve as spacers.

The roller 13 is centrally and annularly cut away at 22 so that the roller proper is constituted by the end hub-like enlargements. This annular groove 22 admits the location of the guide plates as is shown in FIG. 3; this figure also shows the tangential positioning of the guide plates relative to the point of contact between the rollers.

The side frame plates 20 and 21 are held in their spaced relationship by welding 23 or other suitable attachment to the front plate 15. A lower spacer block 24 and an upper spacer block 25 are fastened between the side plates as by the screws which are shown, to further form a rigid frame. The guide plates 10 and 11 are as wide as the space between the side plates 20 and 21 and are held in place by the small projections 26 which enter correspondingly located holes in the side plates.

The drive roller 12 has a central portion of reduced diameter like that of the idler roller 13 so that the end portions are of enlarged hub-like formation. Their surfaces are knurled as shown at 27 or are otherwise roughened to provide a frictional surface to present to the ticket strip. A groove 28 is formed about centrally of the knurled surfaces and in each groove is an O-ring 29 of rubber or like plastic material. It is this O-ring which normally frictionally advances the ticket strip.

The drive or power roller 12 is affixed as by a set screw (not shown) to a shaft 31 which is mounted for slight movement toward and away from the idler shaft 18 while maintaining their parallelism. To accomplish this the shaft 31 is bearinged in a swinging yoke frame 32 of inverted U-shape as is best shown in FIG. 4. This U-frame is made up of the two parallel side bands or strips 33 and 34 and the top spacer block 35 to which they are firmly attached.

Th frame 32 can swing or pivot about the pivot shaft 36 which passes through and is supported by the side plates 10 and 11. The side bands 33 and 34 do not have to be fastened to the pivot shaft 36. The side bands 33 and 34 lie on the outsides of the plates 20 and 21 and of course are clear of the ends of the idler shaft 18 as shown in FIG. 4. To allow the necessary free swing on the shaft 31, holes 37 are formed in the plates 20 and 21.

To swing the frame 32 and thereby the drive roller in the general direction of movement of the tickets, a spring 38 is provided. This is a leaf spring which is fastened to the fixed frame block 25 and which bears at its free end against the yoke block 35. As is shown in FIGS. 1 and 3 this tends to turn the yoke frame in a counterclockwise direction.

As is clear from FIG. 3 the disposition of the drive roller 12 is such that under the biasing action of spring 38 the roller 12 abuts against the idler roller 13 and this is an important feature of the invention as will be explained in a subsequent description of the operation of the machine. At this point it should be noted that the roller 12 is on the ticket supply side of roller 13 and that the roller 12 cannot pass under and forward of the roller 13. Stated differently, the drive roller 12 is located on the ticket supply side of a plane passing through the axis of pivot shaft 36 and through the axis of idler shaft 18.

To accommodate the yoke spacer block 35 the top edges of side plates 20 and 21 are reduced in heighth as is indicated at 39. The deep notches 41 in the side plates 20 and 21 make it possible for the leaf spring 42 to apply a side pressure to the ticket strip to urge it against the opposite side plate 21. Notches 43 in the guide plates permit this spring 42 to bear on the ticket strip. This spring makes sure that the tickets move in a fixed path past a photoelectric cell (not shown) which senses stop notches in the tickets, in a conventional manner.

The drive shaft 31 is long enough to extend through a gear reduction box 45 which it thereby supports. To this gear box is secured an electric motor 46 having the supply wires 47; this is generally a 100 RPM, 12 volt DC motor but other ones may be used. The gear reduction box 45 serves to reduce the drive shaft speed so that the drive roller 12 turns at a few RPM in advancing the tickets. The motor 46 extends into the interior of the machine through a hole 48 in the side plate as this locates the motor in an otherwise unoccupied space and gets it out of the way. The drive shaft 31, of course, turns freely in the housing of the gear box 45 when the motor is driving it.

To stop the rotation of drive shaft 31 when the motor is not turning it, a ratchet gear 51 is affixed to it and for convenience it is located between the yoke frame band 34 and the side plate 21 as is shown in FIGS. 2 and 4. A pawl lever 52 is freely rotatable on the pivot shaft 36 and it has a pointed end 53 which can engage the teeth on the ratchet wheel 51; when so engaged the shaft 31 and drive roller 12 cannot turn in the direction which will advance the tickets to the slot opening 14.

The pawl lever 52 has a lateral extension 54 away from front plate 15 and there is an elongated slot 55 through it. Projecting into this slot 55 is a bolt or pin 56 which is carried by the overlieing portion of the gear box 45. If this gear box, which is mounted on the drive shaft 31 is turned in a clockwise direction, viewed from the side of FIG. 5, the pin 56 will lift the extension 54 with it and turn the engaging end 53 against the ratchet gear 51 to thereby lock roller 12 against turning in a clockwise direction as viewed in FIG. 5.

When the electric motor 46 is energized to turn the drive shaft 31 in a clockwise direction (as viewed in FIG. 5) the reverse reaction torque on the gear box tends to turn the gear box in a counterclockwise direction. The consequent downward movement of pin 56 will serve to turn the pawl lever 52 so that its pointed end 53 will be withdrawn away from the ratchet wheel 51 and the drive shaft 31 will freely turn under the power of the electric motor.

In the operation of the machine, when the electric motor is energized the drive roller 12 will bear on the ticket which is between it and the idler roller and advance it to the delivery slot 14. In this manner one or more tickets will be moved out of the machine, depending on the machine set up. It is most likely that a sensing device of conventional structure will count the tickets being issued and to shut off the motor; such a sensing unit may involve a photo-electric cell for instance.

Only the issued tickets, of course, should be torn off. If, however, the exposed ticket is pulled on in an effort to withdraw additional tickets through the rollers, this action will only serve to bind the tickets more tightly so that no additional one can be pulled out of the machine. Such pulling action will pull the drive roller closer toward the idler roller and this will serve to compress the yieldable O-rings 29 so that the knurled surfaces come up against the tickets to grip them even more frictionally and firmly.

This slight rotation of the drive roller 12 will rotate the drive shaft 31 enough to also rotate the gear box 45 so that its pin 56 lifts the pawl lever 52 and engages its locking end 53 in the ratchet gear 51. This positively stops rotation of the drive shaft 31 and thereby the drive roller 12 so that the latter cannot be rotated. This, coupled with the strong frictional pressure of the knurled surfaces against the ticket strip prevents any slippage of the tickets between the rollers.

When the motor is next energized this reverse torque action explained above releases this strong gripping action so that the O-rings 29 take over to advance the ticket strip. When the current to the motor is cut off it is usual to bring it to an instant stop to prevent a ticket override by momentarily applying a reverse polarity. The high gear ratio assists in this and this frictional resistance in the gear train transmits the turning torque due to a manual pull on the tickets through the gear box so that its pin 56 is moved upwardly and dog end 53 engages sprocket 51.

The drawings which accompany this specification are a full scale representation of a ticket dispenser which is fully reliable and functional. They may be used as working drawings for the manufacture of an apparatus of this same size and dimensions; it will possess the several features and advantages asserted above. Variations from these exact dimensions and measurements can obviously be made but the percentage changes and the changes themselves cannot be exactly defined because of the several variables which are involved.

The rollers can each be made larger or smaller, the distance from the axis of 36 to the axis of 18 can be longer or shorter, the distance from the axis of 36 to the axis of 31 can be more or less and the thickness of the tickets are factors which may be varied from the measurements shown. It can be said that the distance from the axis of 36 to the axis of 31 plus the radius of the knurled surface of the drive roller, should be only a few or a small percent greater than the distance from the axis of 36 to the axis of 18 minus the radius of the idler roller.

The exact changes cannot be exactly set forth but in functional and empirical terms it can be said that the rollers must not touch so lightly that they can be jammed against each other and will not become released when power is applied. Nor can the rollers be so close together that they will not effectively grip the tickets when the ticket is manually pulled. These limits can easily be determined in practice.

I claim:

1. A ticket dispensing apparatus comprising an idler roller, a fixed framework in which the idler roller is rotatably mounted, a drive roller disposed to press tickets against the idler roller, controllable power means connected to the drive roller to rotate it and therby advance tickets between it and the idler roller, a frame movable relative to the framework and in which the drive roller is rotatably mounted and which also disposes the drive roller on the side of the idler roller from which the tickets are supplied to the rollers, bias means which constantly bear on the movable frame to urge the drive roller toward the idler roller to constantly bear on the ticket between the rollers, support means between the movable frame and the framework directing the movement of the movable frame so the axis of the driven roller moves in a path which is inclined toward and intersects the path of movement of the tickets on the delivery side away from the rollers, the drive roller being located so that it cannot move past the idler roller in the direction of the ticket movement because it abuts against the idler roller, said positioning of the drive roller and the path of movement of its axis relative to the idler roller and ticket movement thereby causing a manual pull on the tickets to bring the drive roller firmly toward the idler roller and tightly grip the tickets against movement between the rollers.

2. The apparatus of claim 1 in which the drive roller has a rough frictional surface in which is disposed an annular ring of compressible material of greater size and which can yield to present the friction surface to the tickets.

3. The apparatus of claim 1 in which the movable frame is a yoke which is pivotally connected to the framework.

4. The apparatus of claim 1 in which the movable frame is spring biased toward the idler roller.

5. The apparatus of claim 1 in which spaced guide plates provide a ticket passageway which is tangential to the point of contact between the rollers.

6. Apparatus according to claim 1 in which the movable frame is a yoke which is pivotally connected to the framework and the axis of the drive roller is offset from the plane through the axis of the pivotal connection and the axis of the idler roller.

7. The apparatus of claim 1 in which the drive roller is affixed to a shaft which is bearinged in said frame and said power means includes an electric motor driven speed reducing gear train which supported on the shaft and in which the shaft can rotatably turn.

8. The apparatus of claim 7 in which the gear train has a high internal friction which prevents rotation of the electric motor by rotation of the drive roller.

9. The apparatus of claim 1 in which the drive roller and a ratchet wheel are affixed to a common shaft, a ratchet dog is pivotally supported by the framework for movement to and away from the ratchet wheel and connecting means operatively move the pawl into locking engagement with the ratchet wheel upon manual rotation of the drive wheel by a pull on the tickets.

10. The apparatus of claim 9 in which said connecting means includes a coupling between the power means and the ratchet dog.

* * * * *